US008505467B1

(12) United States Patent
Roberts et al.

(10) Patent No.: US 8,505,467 B1
(45) Date of Patent: Aug. 13, 2013

(54) PRODUCT PROTECTION GUARDS

(75) Inventors: Ronald Bruce Roberts, Temple, GA (US); Christopher Shaun Roberts, Stow, OH (US)

(73) Assignees: Ronald Bruce Roberts, Temple, GA (US); Christopher Shaun Roberts, Stow, OH (US)

( * ) Notice: Subject to any disclaimer, the term of this patent is extended or adjusted under 35 U.S.C. 154(b) by 0 days.

(21) Appl. No.: 13/447,592

(22) Filed: Apr. 16, 2012

(51) Int. Cl.
*B65D 19/00* (2006.01)

(52) U.S. Cl.
USPC ..... 108/51.11; 108/57.12; 248/345.1

(58) Field of Classification Search
USPC ..... 108/51.11, 55.1, 57.12, 27; 206/597; 248/345.1
See application file for complete search history.

(56) References Cited

U.S. PATENT DOCUMENTS 3,371,815 A * 3/1968 Macomber ..... 206/597
3,645,215 A * 2/1972 Kirkpatrick ..... 108/57.23
4,852,330 A * 8/1989 Carangelo ..... 206/597
5,369,925 A * 12/1994 Vargo ..... 248/345.1
6,044,601 A * 4/2000 Chmela et al. ..... 248/345.1
6,102,611 A * 8/2000 Roller ..... 404/6
6,176,062 B1 * 1/2001 Fayle ..... 52/835
6,242,070 B1 * 6/2001 Gillispie et al. ..... 428/99
6,260,487 B1 * 7/2001 Giorgio ..... 108/51.11
6,408,768 B1 * 6/2002 Giampavolo et al. ..... 108/27
8,267,262 B2 * 9/2012 Thelwell ..... 248/345.1
2004/0094496 A1 * 5/2004 MacDonald ..... 211/189
2008/0029676 A1 * 2/2008 Huxtable et al. ..... 248/345.1

OTHER PUBLICATIONS

U.S. Cargo Control, http://www.uscargocontrol.com/Flatbed-Trailer-Products/Corner-Protectors , Apr. 9, 2012.

* cited by examiner

*Primary Examiner* — Jose V Chen
(74) *Attorney, Agent, or Firm* — Hahn Loeser & Parks LLP; Carlos P. Garritano

(57) ABSTRACT

The claimed subject matter provides a protection system for cargo on a portable platform. The protection system includes a corner protection member and/or a side protection member, wherein at least one opening is on the corner protection member and at least one opening is on the side protection member. The corner protection member contacts a corner of a portable platform and the side protection member contacts a side of a portable platform. A strap can lace into at least one of the opening on the corner protection member and/or the side protection member to bear force from such strap.

19 Claims, 8 Drawing Sheets

PRODUCT PROTECTION GUARDS

BACKGROUND

With the advent of technology such as computers, the Internet, and the like, commerce activity has increased to extraordinary proportions. For instance, a person can order an item from a website and have it delivered to his or her house in a matter of hours. Regardless of the point of sale being a home, a store, or a factory, these good are shipped to various locations all around the globe. This has led to an increase in deliveries, delivery techniques, and a demand for efficient transporting or delivery of cargo. In particular, trucks, trains, freight trucks, trailers, boats, airplanes, and/or couriers often deliver goods or products to specific destinations.

Often, portable platforms are utilized in the shipping industry to handle, store, or move cargo (e.g., goods, products, items, etc.) in bulk. In one example, a portable platform can be a pallet, wherein cargo is stacked thereupon in order to facilitate transporting cargo from one location to another. For instance, a pallet of cargo can be moved with a forklift or other machinery that allows efficient loading and/or unloading. Conventionally, a forklift or other machinery can move a pallet with cargo from a factory floor to a delivery truck. In any event, a single portable platform enables multiple pieces of cargo to be handled rather than handling each piece of cargo one piece at a time.

Although cargo can be stacked upon a portable platform for efficient transport between locations, additional techniques are needed to further secure cargo to the portable platform while the portable platform is moved, transported, delivered, and the like. Conventionally, the cargo can be wrapped and further secured to a portable pallet with, for instance, nets, tarpaulins, shrink-wrap, stretch-wrap, tape, straps, banding, and the like. Conventionally, cargo is placed on a portable platform and tightly wrapped or surrounded with stretch-wrap. These techniques allow cargo to be secured while stacked or placed onto a portable platform. Yet, each portable platform with cargo still requires to be secured to restrict movement during physical transport. However, conventional techniques are often inadequate to prevent damage to cargo during transport. Even more so, in most cases, such conventional techniques cause damage to cargo while trying to secure cargo during transport and/or delivery.

SUMMARY

The following presents a simplified summary of the innovation in order to provide a basic understanding of some aspects described herein. This summary is not an extensive overview of the claimed subject matter. It is intended to neither identify key or critical elements of the claimed subject matter nor delineate the scope of the subject innovation. Its sole purpose is to present some concepts of the claimed subject matter in a simplified form as a prelude to the more detailed description that is presented later.

The subject innovation relates to a cargo protection system (e.g., product protection guards, product protection members, etc.). The cargo protection system includes a corner protection member (also referred to as a corner protection guard) and/or a side protection member (also referred to as a side protection guard), wherein at least one opening is located on the corner protection member and at least one opening is located on the side protection member. The corner protection member contacts a corner of a portable platform (and, in turn, corner(s) of cargo placed thereon) and the side protection member contacts a side of a portable platform (and, in turn, side(s) of cargo placed thereon). A strap can lace through at least one of the opening on the corner protection member and/or the side protection member to bear force from such strap thereby alleviating an amount of force the cargo would bear. In other words, the corner protection member and/or the side protection member afford support to cargo stacked upon a portable platform as well as damage protection by allowing a strap to lace through the at least one openings on the corner and/or side protection member(s) rather than the strap directly contacting cargo.

The following description and the annexed drawings set forth in detail certain illustrative aspects of the claimed subject matter. These aspects are indicative, however, of but a few of the various ways in which the principles of the innovation may be employed and the claimed subject matter is intended to include all such aspects and their equivalents. Other advantages and novel features of the claimed subject matter will become apparent from the following detailed description of the innovation when considered in conjunction with the drawings.

DETAILED DESCRIPTION

Figure 1:
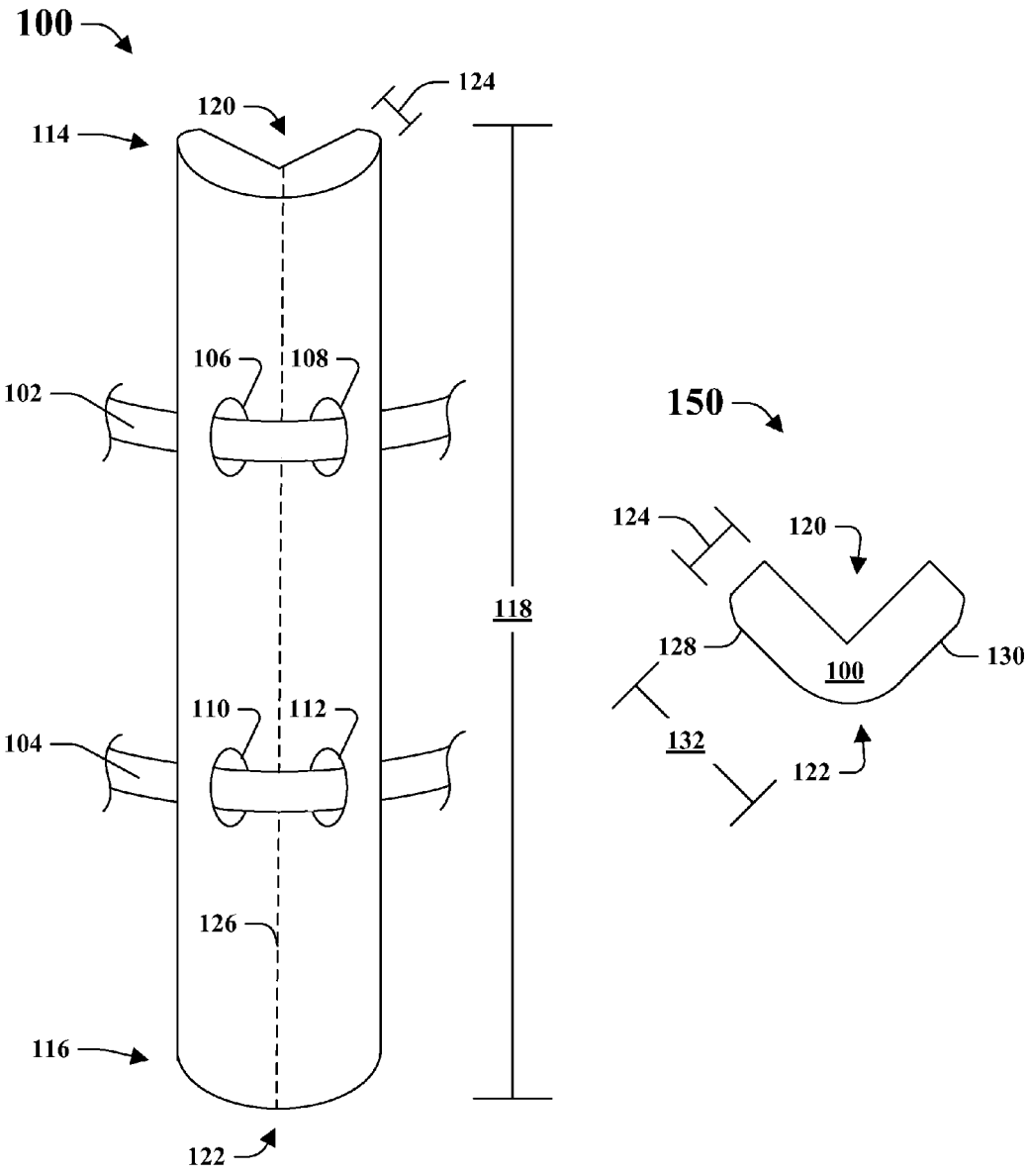
FIG. 1 illustrates a corner protection member.

The subject innovation pertains generally to a corner protection member and a side protection member that facilitate preventing damage to cargo. In particular, the corner protection member and/or the side protection member include two or more openings that allow one or more straps to be laced such that a tension from the one or more straps is supported by the corner protection member and/or the side protection member rather than the cargo. Since the corner protection member and/or the side protection member bear a force from the one or more straps, the cargo is protected from damage caused by tightening and securing the one or more straps. Conventionally, a tightened strap would apply force directly to the cargo which leads to a damaging force to the cargo. Moreover, this damaging force often collapses or indents cargo which lowers the tension initially applied leading to a less-secured cargo. By utilizing a corner protection member and/or a side protection member, the tension from one or more straps can be increased and maintained to ensure stability while the corner protection member and/or the side protection member bear the force from the one or more straps rather than the cargo. Thus, the cargo is more secure and stable as well as protected from damage from the use of one or more straps by utilizing the corner protection member and/or the side protection member.

The claimed subject matter is described with reference to the drawings, wherein like reference numerals are used to refer to like elements throughout. In the following description, for purposes of explanation, numerous specific details are set forth in order to provide a thorough understanding of the subject innovation. It may be evident, however, that the claimed subject matter may be practiced without these specific details. In other instances, well-known structures and devices are shown in block diagram form in order to facilitate describing the subject innovation.

Features that are described and/or illustrated with respect to one embodiment may be used in the same way or in a similar way in one or more other embodiments and/or in combination with or instead of the features of the other embodiments. These and further aspects and features will be apparent with reference to the following description and attached drawings. In the description and drawings, particular embodiments of the subject innovation have been disclosed in detail as being indicative of some of the ways in which the principles of the subject innovation may be employed, but it is understood that the subject innovation is not limited correspondingly in scope. Rather, the subject innovation includes all changes, modifications and equivalents coming within the scope of the claims appended hereto. The accompanying illustrations are examples of the subject disclosure, but the innovation can appear in various embodiments depending on varying sleeve lengths and personal customizations that are not illustrated here.

Of course, those skilled in the art will recognize many modifications may be made to this configuration without departing from the scope or spirit of the claimed subject matter. Moreover, the word "exemplary" is used herein to mean serving as an example, instance, or illustration. Any aspect or design described herein as "exemplary" is not necessarily to be construed as preferred or advantageous over other aspects or designs. It should be emphasized that the term "comprises/comprising" when used in this specification is taken to specify the presence of stated features, integers, steps or components but does not preclude the presence or addition of one or more other features, integers, steps, components or groups thereof.

FIG. 1 illustrates a corner protection member 100. The corner protection member 100 protects cargo from damage. In particular, the corner protection member 100 can contact a corner of a portable platform (not shown, See FIG. 4) and stacked cargo in order to bear force from one or more straps (e.g., an upper strap 102 and a lower strap 104) that secure the portable platform and cargo to a horizontal e-track rail (not shown). The corner protection member 100 allows the upper strap 102 to lace through an upper set of openings that includes a first opening 106 and a second opening 108, wherein the tightening of the upper strap 102 applies force to the corner protection member 100 rather than the cargo and/or the portable platform. Similarly, the corner protection member 100 allows the lower strap 104 to lace through a lower set of openings that includes a first opening 110 and a second opening 112, wherein the tightening of the lower strap 104 applies force to the corner protection member 100 rather than the cargo and/or the portable platform. It is to be appreciated that the openings (e.g., the first opening 106, the second opening 108, the first opening 110, and the second opening 112) can be any suitable shape such as, but not limited to, an oval, a circle, a square, a rectangle, a diamond, and the like.

The corner protection member 100 includes a top end 114 and a bottom end 116, wherein the top end 114 separates the bottom end 116 by a length 118. It is to be appreciated that the length 118 can be any suitable length that benefits a particular cargo and/or portable platform. For example, the length 118 can vary based upon a characteristic of the cargo and/or the portable platform, wherein the characteristic can be, but is not limited to, height, size, shape, type, contents, etc. In a particular example, the length 118 can be approximately seven (7) feet. By way of example and not limitation, the length 118 can be in a range from approximately two (2) feet to approximately twelve (12) feet. However, it is to be appreciated that such range for the length 118 is intended solely for illustrative purposes and is not to be limiting on the subject innovation.

The top end 114 is separated by the length 118 from the bottom end 116 to create an inner side 120 and an outer side 122. The inner side 120 is separated by the outside 122 by a thickness 124. The inner side 120 can be formed to fit a corner at approximately a right angle in which the corner fitting form is lengthwise from the top end 114 to the bottom end 116 and the corner fitting form is on a midline 126. Moreover, the outer side 122 can be rounded in shape to form a curved surface. The rounded shape and curved surface of the outer side 122 enables minimal (if any) wear on one or more straps (e.g., upper strap 102, lower strap 104, etc.) or any other bands, rope, and the like.

Turning quickly to a top view 150 in FIG. 1, the corner protection member 100 is illustrated from a top angle view looking downwards from the top end 114 to the bottom end 116. As depicted, the inner side 120 can include a corner fitting shape that is lengthwise for the length 118. Moreover, the corner fitting shape can be located at the midline 126 between a left edge 128 and a right edge 130. It is to be appreciated that the corner fitting shape on the inner side 120 can be rounded or curved rather than a sharp corner or 90 degree angle. Additionally, the outer side 122 is illustrated with a rounded shape to form a curved surface. For instance, rather than a sharp corner at the midline 126, a curve or rounded edge exists between the left edge 128 and the right edge 130. Furthermore, the edges connecting the outer side 122 to the inner side 120 can be, for instance, rounded or curved in order to mitigate sharp edges that may damage one or more straps (e.g., upper strap 102, lower strap 104, etc.) or any other bands, rope, and the like.

Furthermore, the inner side 120 and the outer side 122 can be separated by the thickness 124. It is to be appreciated that the thickness 124 can be any suitable thickness that benefits a particular cargo and/or portable platform. For example, the thickness 124 can vary based upon a characteristic of the cargo and/or the portable platform, wherein the characteristic can be, but is not limited to, weight, size, shape, type, contents, etc. In a particular example, the thickness 124 can be approximately ⅝ inches. By way of example and not limitation, the thickness 124 can be in a range from approximately ¼ inches to approximately three (3) inches. However, it is to be appreciated that such range for the thickness 124 is intended solely for illustrative purposes and is not to be limiting on the subject innovation.

The left edge 128 can include a length 132, wherein the length 132 can be approximately three (3) inches. In general, the length 132 can be in a range of approximately two (2) inches to approximately eight (8) inches. However, it is to be appreciated that the range of values for the length 132 is solely for illustrative purposes and is not to be limiting on the subject innovation. Similarly, the right edge 130 can include a length (not shown), wherein the length can be approximately three (3) inches. In general, the length can be in a range of approximately two (2) inches to approximately eight (8) inches. However, it is to be appreciated that the range of values for the length is solely for illustrative purposes and is not to be limiting on the subject innovation. Generally, the length of the right edge 130 and the left edge 128 can be substantially similar. However, it is to be appreciated that the length 132 for the left edge 128 and the length for the right edge 130 can be different based upon a particular cargo and/or portable platform.

Turning back to the view of corner protection member illustrated in 100, the upper set and lower set of openings are further described. The upper set of openings (e.g., the first opening 106 and the second opening 108) and the lower set of openings (e.g., the first opening 110 and the second opening 112) are orifices that extend from the outer side 122 through to the inner side 120. Moreover, the upper set of openings (e.g., the first opening 106 and the second opening 108) can be located on the same horizontal plane on an upper portion of the corner protection member 100. In other words, the upper set of openings can be located at substantially the same height (e.g., measured from the top end 114 to the bottom end 116). It is to be appreciated that the upper set of openings can be at any suitable height located on the length 118. For example, the upper set of openings can be approximately twenty-eight (28) inches from the top end 114 (e.g., measured from the top end 114 to a top portion of the upper set of openings). Additionally, the first opening 106 can be centered between the left edge 128 and the midline 126, whereas the second opening 108 can be centered between the right edge 130 and the midline 126.

Moreover, the lower set of openings (e.g., the first opening 110 and the second opening 112) can be located on the same horizontal plane on a lower portion of the corner protection member 100. In other words, the lower set of openings can be located at substantially the same height (e.g., measured from the bottom end 116 to the top end 114). It is to be appreciated that the lower set of openings can be at any suitable height located on the length 118. For example, the lower set of openings can be approximately 23¼ inches from the bottom end 116 (e.g., measured from the bottom end 116 to a bottom portion of the lower set of openings). Additionally, the first opening 110 can be centered between the left edge 128 and the midline 126, whereas the second opening 112 can be centered between the right edge 130 and the midline 126.

In a particular instance, the upper set of openings (e.g., first opening 106, second opening 108) and the lower set of openings (e.g., first opening 110, second opening 112) can be separated by a distance (e.g., measured from an upper portion of the lower set of openings to a lower portion of the upper set of openings). For instance, the distance can be approximately 25¾ inches. In general, the distance can be in a range between approximately ten (10) inches to approximately seventy (70) inches. However, it is to be appreciated that such range for the distance is intended solely for illustrative purposes and is not to be limiting on the subject innovation.

It is to be appreciated that a size for the openings (e.g., the upper set of openings on the corner protection member 100, the lower set of openings on the corner protection member 100) can be any suitable size. For example, the size of the openings can be dependent upon the one or more straps (e.g., upper strap 102, lower strap 104, etc.), wherein the one or more straps can be, but are not limited to, an e-strap, a rope, a banding, a nylon strap, and the like. By way of example and not limitation, the size of each opening can be substantially oval with a width of approximately ¾ inches and a height of approximately 3¼ inches. In general, the height of the opening can be in a range of approximately one (1) inch to approximately ten (10) inches and the width of the opening can be in a range of approximately ¼ inch to approximately four (4) inches. It is to be appreciated that the stated size ranges and shapes for the opening are for illustrative purposes only and not to be seen as limiting to the subject innovation.

Generally, the openings (e.g., the upper set of openings on the corner protection member 100, the lower set of openings on the corner protection member 100) can be at any suitable height based on various criteria (e.g., cargo type, cargo size, portable platform type, delivery method, vehicle for transport or movement, etc.). In a particular example, the height of the openings can be on a horizontal plane parallel to a horizontal e-track rail. For instance, a mode of transport (e.g., vehicle, truck, trailer, plane, train, boat, etc.) can include horizontal e-track rails that enable one or more straps (e.g., upper strap 102, lower strap 104) to attach thereto. Additionally, the mode of transport typically includes an upper e-track rail and a lower e-track rail. It is to be appreciated that the upper set of openings on the corner protection member 100 can be on a plane equivalent to a plane of an upper e-track rail, whereas the lower set of openings on the corner protection member 100 can be on a plane equivalent to a plane of a lower e-track rail.

Although depicted with an upper set of openings and a lower set of openings, it is to be appreciated that the corner protection member 100 may include one set of openings (e.g., a first opening and a second opening). By way of example and not limitation, the corner protection member 100 can include a single set of openings which allow a strap to lace therein. Moreover, it is to be appreciated that the corner protection member 100 can include a single opening rather than a set of openings.

As discussed above, the set of openings (e.g., upper set of openings on the corner protection member 100, lower set of openings on the corner protection member 100) allow at least one strap to lace therein. For example, a strap can enter the first opening 106 in which the strap is in contact with the inner side 120. The strap exits the first opening 106 to contact the outer side 122 and enters the second opening 108. The strap exits the second opening 108 to contact the inner side 120.

Additionally, it is to be appreciated that the corner protection member 100 can be fabricated, constructed, or made from any suitable material. For example, the material can be, but is not limited to, a plastic, a high-density polyethylene, a carbon, a composite material, a metal, a wood, a synthetic material, and/or any suitable combination thereof.

Furthermore, the subject innovation refers to a portable platform. It is to be appreciated that the portable platform can be any suitable structure in which cargo is stacked or placed thereon for movement, shipment, delivery, and/or storage. For instance, the portable platform can be, but is not limited to, a pallet, a wood pallet, a standard reversible pallet, a stevedore type double wing pallet, a premium panel deck stringer pallet, a heavy duty two way stringer pallet, a heavy duty stringer pallet notched for four-way entry, a grocery industry four-way pallet, a perimeter base block pallet, a single faced skid, a single wing pallet with option chamfer on bottom boards, and the like.

Figure 2:
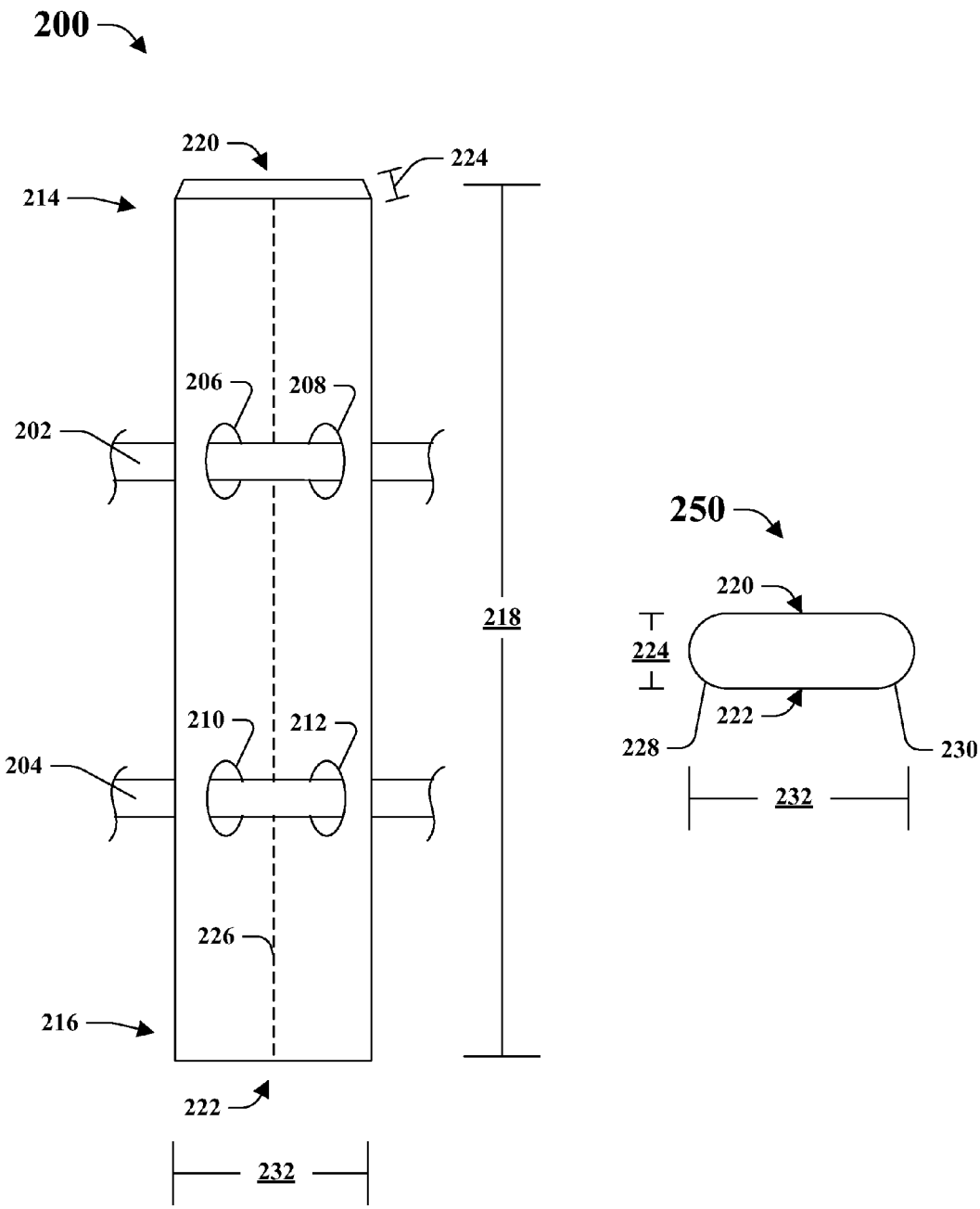
FIG. 2 illustrates a side protection member.

FIG. 2 illustrates a side protection member 200. The side protection member 200 protects cargo from damage. In particular, the side protection member 200 can contact a side of a portable platform (not shown, See FIG. 5) and stacked cargo in order to bear force from one or more straps (e.g., an upper strap 202 and a lower strap 204) that secures the portable platform and cargo to a horizontal e-track rail (not shown). The side protection member 200 allows the upper strap 202 to lace through an upper set of openings that includes a first opening 206 and a second opening 208, wherein the tightening of the upper strap 202 applies force to the side protection member 200 rather than the cargo and/or the portable platform. Similarly, the side protection member 200 allows the lower strap 204 to lace through a lower set of openings that includes a first opening 210 and a second opening 212, wherein the tightening of the lower strap 204 applies force to the side protection member 200 rather than the cargo and/or the portable platform. It is to be appreciated that the openings (e.g., the first opening 206, the second opening 208, the first opening 210, and the second opening 212) can be any suitable shape such as, but not limited to, an oval, a circle, a square, a rectangle, a diamond, and the like.

The side protection member 200 includes a top end 214 and a bottom end 216, wherein the top end 214 separates the bottom end 216 by a length 218. It is to be appreciated that the length 218 can be any suitable length that benefits a particular cargo and/or portable platform. For example, the length 218 can vary based upon a characteristic of the cargo and/or the portable platform, wherein the characteristic can be, but is not limited to, height, size, shape, type, contents, etc. In a particular example, the length 218 can be approximately seven (7) feet. By way of example and not limitation, the length 218 can be in a range from approximately two (2) feet to approximately twelve (12) feet. However, it is to be appreciated that such range for the length 218 is intended solely for illustrative purposes and is not to be limiting on the subject innovation.

The top end 214 is separated by the length 218 from the bottom end 216 to create an inner side 220 and an outer side 222. The inner side 220 is separated by the outside 222 by a thickness 224. It is to be appreciated that the inner side 220 and the outer side 222 of the side protection member 200 are substantially flat with rounded edges (as discussed in further detail below).

Turning quickly to a top view 250 in FIG. 2, the side protection member 200 is illustrated from a top angle view looking downwards from the top end 214 to the bottom end 216. As depicted, the inner side 220 can include a substantially flat shape that is across a distance 232 and lengthwise for the length 218. The substantially flat shape enables the side protection member 200 to contact a surface of the portable platform and/or the cargo. Additionally, the outer side 222 is illustrated with a substantially flat shape that is across the distance 232 and lengthwise for the length 218. Furthermore, the edges (e.g., a left edge 228 and a right edge 230) connecting the outer side 222 to the inner side 220 can be, for instance, rounded or curved in order to mitigate sharp edges that may damage one or more straps (e.g., upper strap 202, lower strap 204, etc.) or any other bands, rope, and the like.

Furthermore, the inner side 220 and the outer side 222 can be separated by the thickness 224. It is to be appreciated that the thickness 224 can be any suitable thickness that benefits a particular cargo and/or portable platform. For example, the thickness 224 can vary based upon a characteristic of the cargo and/or the portable platform, wherein the characteristic can be, but is not limited to, weight, size, shape, type, contents, etc. In a particular example, the thickness 224 can be approximately ⅝ inches. By way of example and not limitation, the thickness 224 can be in a range from approximately ¼ inches to approximately three (3) inches. However, it is to be appreciated that such range for the thickness 224 is intended solely for illustrative purposes and is not to be limiting on the subject innovation.

The left edge 228 can be separated from the right edge 230 with the distance 232 (e.g., width of side protection member 200). The distance 232 can be approximately six (6) inches. In general, the distance 232 can be in a range of approximately two (2) inches to approximately twelve (12) inches. However, it is to be appreciated that the range of values for the distance 232 is solely for illustrative purposes and is not to be limiting on the subject innovation.

Turning back to the view of side protection member illustrated in 200, the upper set and lower set of openings are further described. The upper set of openings (e.g., the first opening 206 and the second opening 208) and the lower set of openings (e.g., the first opening 210 and the second opening 212) are orifices that extend from the outer side 222 through to the inner side 220. Moreover, the upper set of openings (e.g., the first opening 206 and the second opening 208) can be located on the same horizontal plane on an upper portion of the side protection member 200. In other words, the upper set of openings can be located at substantially the same height (e.g., measured from the top end 214 to the bottom end 216). It is to be appreciated that the upper set of openings can be at any suitable height located on the length 218. For example, the upper set of openings can be approximately twenty-eight (28) inches from the top end 214 (e.g., measured from the top end 214 to a top portion of the upper set of openings). Additionally, the first opening 206 can be centered between the left edge 228 and a midline 226, whereas the second opening 208 can be centered between the right edge 230 and the midline 226.

Moreover, the lower set of openings (e.g., the first opening 210 and the second opening 212) can be located on the same horizontal plane on a lower portion of the side protection member 200. In other words, the lower set of openings can be located at substantially the same height (e.g., measured from the bottom end 216 to the top end 214). It is to be appreciated that the lower set of openings can be at any suitable height located on the length 218. For example, the lower set of openings can be approximately 23¼ inches from the bottom end 216 (e.g., measured from the bottom end 216 to a bottom portion of the lower set of openings). Additionally, the first opening 210 can be centered between the left edge 228 and the midline 226, whereas the second opening 212 can be centered between the right edge 230 and the midline 226.

In a particular instance, the upper set of openings (e.g., first opening 206, second opening 208) and the lower set of openings (e.g., first opening 210, second opening 212) can be separated by a distance (e.g., measured from an upper portion of the lower set of openings to a lower portion of the upper set of openings). For instance, the distance can be approximately 25¾ inches. In general, the distance can be in a range between approximately ten (10) inches to approximately seventy (70) inches.

It is to be appreciated that a size for the openings (e.g., the upper set of openings, the lower set of openings) can be any suitable size. For example, the size of the openings can be dependent upon the one or more straps (e.g., upper strap 202, lower strap 204, etc.), wherein the one or more straps can be, but are not limited to, an e-strap, a rope, a banding, a nylon strap, and the like. By way of example and not limitation, the size of each opening can be substantially oval with a width of approximately ¾ inches and a height of approximately 3¼ inches. In general, the height of the opening can be in a range of approximately one (1) inch to approximately ten (10) inches and the width of the opening can be in a range of approximately ¼ inch to approximately four (4) inches. It is to be appreciated that the stated size ranges and shapes for the opening are for illustrative purposes only and not to be seen as limiting to the subject innovation.

Generally, the openings (e.g., the upper set of openings on the side protection member 200, the lower set of openings on the side protection member 200) can be at any suitable height based on various criteria (e.g., cargo type, cargo size, portable platform type, delivery method, vehicle for transport or movement, etc.). In a particular example, the height of the openings can be on a horizontal plane parallel to a horizontal e-track rail. For instance, a mode of transport (e.g., vehicle, truck, trailer, plane, train, boat, etc.) can include horizontal e-track rails that enable one or more straps (e.g., upper strap 202, lower strap 204) to attach thereto. Additionally, the mode of transport typically includes an upper e-track rail and a lower e-track rail. It is to be appreciated that the upper set of openings on the side protection member 200 can be on a plane equivalent to a plane of an upper e-track rail, whereas the lower set of openings on the side protection member 200 can be on a plane equivalent to a plane of a lower e-track rail.

Although depicted with an upper set of openings and a lower set of openings, it is to be appreciated that the side protection member 200 may include one set of openings (e.g., a first opening and a second opening). By way of example and not limitation, the side protection member 200 can include a single set of openings which allow a strap to lace therein. Moreover, it is to be appreciated that the side protection member 200 can include a single opening rather than a set of openings.

As discussed above, the set of openings (e.g., upper set of openings on the side protection member 200, lower set of openings on the side protection member 200) allow at least one strap to lace therein. For example, a strap can enter the first opening 206 in which the strap is in contact with the inner side 220. The strap exits the first opening 206 to contact the outer side 222 and enters the second opening 208. The strap exits the second opening 208 to contact the inner side 220.

Additionally, it is to be appreciated that the side protection member 200 can be fabricated, constructed, or made from any suitable material. For example, the material can be, but is not limited to, a plastic, a high-density polyethylene, a carbon, a composite material, a metal, a wood, a synthetic material, and/or any suitable combination thereof.

Figure 3:
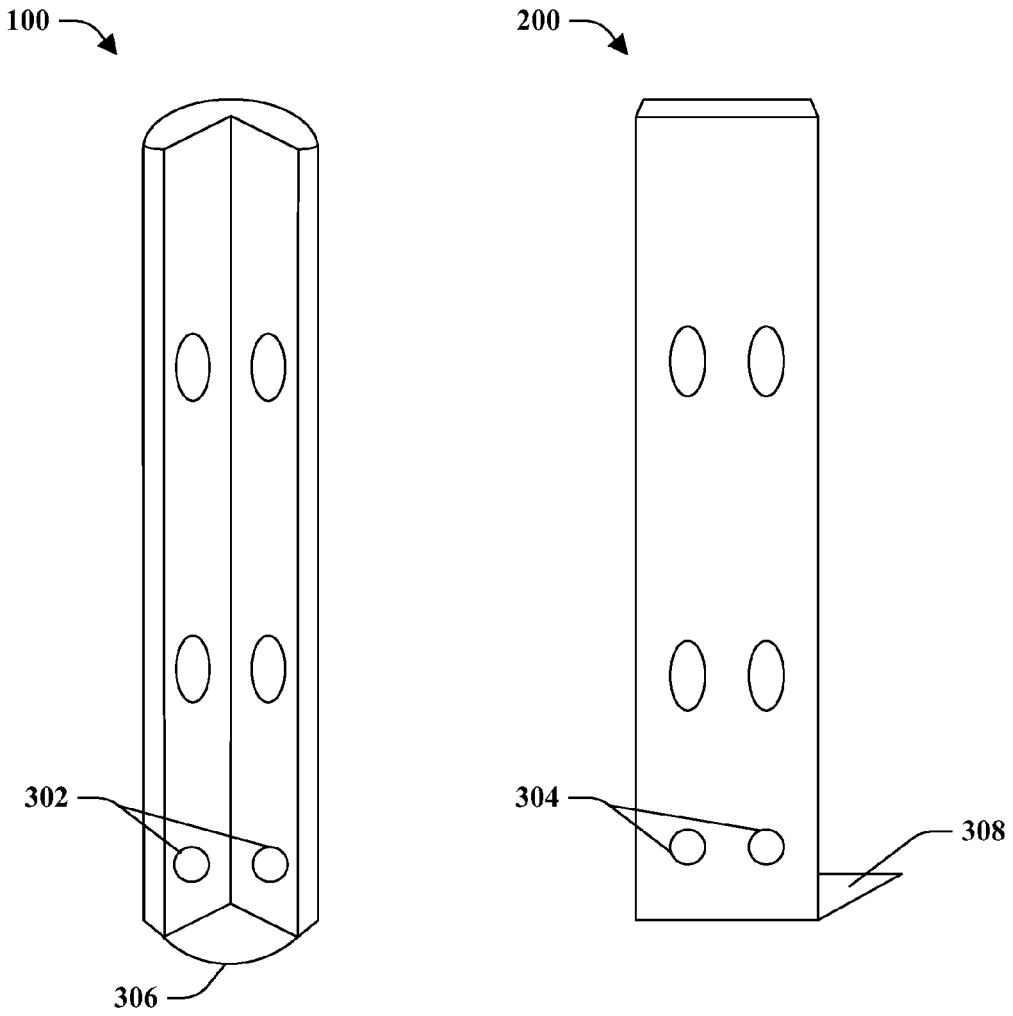
FIG. 3 illustrates a protection system that includes a corner protection member and a side protection member.

FIG. 3 illustrates a protection system 300 that includes the corner protection member 100 and the side protection member 200. The protection system 300 can include the corner protection member 100 (as described in FIG. 1) and the side protection member 200 (as described in FIG. 2). The corner protection member 100 encases a corner of a portable platform and/or cargo placed thereon, whereas the side protection member 200 contacts a side (e.g., a center of a side) of the portable platform and/or cargo.

In particular, the corner protection member 100 can contact a corner of the portable platform and the side protection member 200 can contact a side of the portable platform, wherein at least one strap can lace through a set of openings. For instance, the corner protection member 100 can include an upper set of openings and a lower set of openings. A first strap can lace into the upper set of openings while a second strap can lace into a lower set of openings. Additionally, the side protection member 200 can include an upper set of openings and a lower set of openings in which the first strap can lace through the upper set of openings while the second strap laces through the lower set of openings. By lacing the first strap and/or the second strap through the set of openings (e.g., upper and/or lower), the corner protection member 100 and/or the side protection member 200 protect cargo and/or the portable platform from a force generated by the first strap and/or the second strap.

For instance, a mode of transport (e.g., truck, trailer, freight truck, train, plane, boat, etc.) can include e-track rails. E-track rails can be attached to a wall or floor of the mode of transport. Typically, e-track rail is attached to a sidewall of the mode of transport (e.g., herein referred to as horizontal e-track rail) such that there is an upper horizontal e-track rail and a lower horizontal e-track rail. A strap or other mechanism (e.g., cargo nets, rope, banding, etc.) can attach to the horizontal e-track rail and tightened. In one example, the strap is an e-strap that is tightened by a ratchet mechanism (e.g., ratcheting e-strap). By attaching the ratcheting e-strap to the horizontal e-track rail, and lacing the e-strap through the set of openings on the corner protection member 100 and/or the side protection member 200, the cargo is protected.

The corner protection member 100 can include an additional access opening 302. Additionally, the side protection member 200 can include an additional access opening 304. The additional access opening 302 and/or the additional access opening 304 (e.g., herein referred to collectively as "additional access openings 302 and 304") can be located on a lower portion of the corner protection member 100 and/or a lower portion of the side protection member 200. In particular, the additional access opening 302 can be one or more orifices that extend through an inner side to an outer side of the corner protection member 100. Furthermore, the additional access openings 304 can be one or more orifices that extend through an inner side to an outer side of the side protection member 200.

Generally, the additional access openings 302 and 304 allow physical coupling to a portable platform. For example, the physical coupling can be a temporary coupling and/or a permanent coupling. The additional access openings 302 and 304 can be access points in which, for instance, a nail, a screw, a bolt, a nut, a staple, and the like, are utilized to physically couple the corner protection member 100 and/or the side protection member 200 to a portable platform.

In an example, a padding material (not shown) can be incorporated onto the inner side of the corner protection member 100 and/or the inner side of the side protection member 200. In general, the padding material can afford further protection to cargo upon placement of the corner protection member 100 and/or the side protection member 200 in contact with the portable platform and/or the cargo.

Still further, a foot member 306 can be affixed to the corner protection member 100. In particular, the foot member 306 can be affixed to a bottom side of the corner protection member 100, wherein the foot member 306 is substantially flat. The foot member 306 can provide vertical stability to the corner protection member 100 by sliding under a portion of the portable platform. In particular, the foot member 306 can tuck under a corner of the portable platform in which a weight of the portable platform and cargo will generate a downward force onto the foot member 306 which holds (e.g., restricts movement of) the corner protection member 100 in place. It is to be appreciated that the foot member 306 can be any suitable size, shape, and/or thickness. For instance, the rounded edge of the foot member 306 is for illustrative purposes and is not to be limiting on the subject innovation.

Additionally, a foot member 308 can be affixed to the side protection member 200. In particular, the foot member 308 can be affixed to a bottom side of the side protection member 200, wherein the foot member 308 is substantially flat. The foot member 308 can provide vertical stability to the side protection member 200 by sliding under a portion of the portable platform. In particular, the foot member 308 can tuck under a side of the portable platform in which a weight of the portable platform and cargo will generate a downward force onto the foot member 308 which holds (e.g., restricts movement of) the side protection member 200 in place. It is to be appreciated that the foot member 308 can be any suitable size, shape, and/or thickness.

It is to be appreciated that the corner protection member 100 and/or the side protection member 200 can include an area on an outer side (e.g., the outer side 122 on the corner protection member 100, the outer side 222 on the side protection member 200, See FIGS. 1 and 2 respectively). This area can be utilized to place letter(s), number(s), a logo, an advertisement, and the like. For example, a manufacturer or company can include a company name on the area of the corner protection member 100 and/or the side protection member 200. In another example, the area can include cargo identification such as shipping information and the like.

Figure 4:
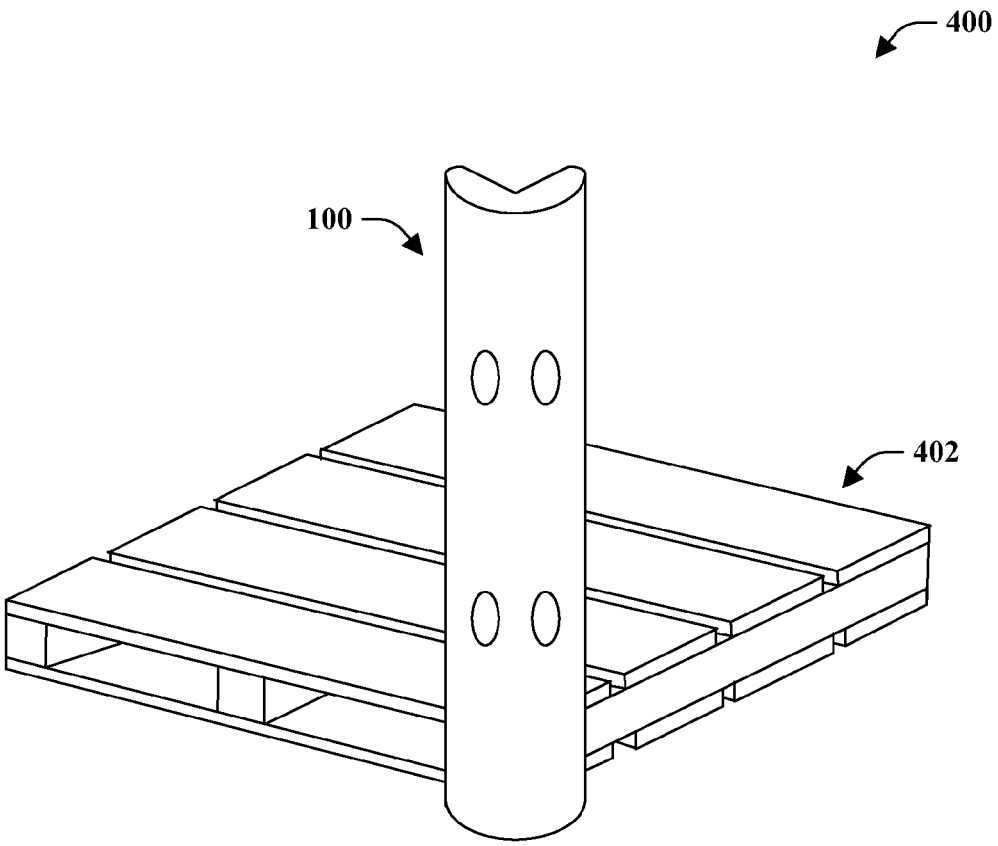
FIG. 4 illustrates a corner protection member for a portable platform.

FIG. 4 illustrates a system 400 that includes the corner protection member 100 for a portable platform. The system 400 can afford protection and prevent damage to cargo (not shown) that is placed on a portable platform 402. For instance, cargo can be placed on the portable platform 402, stacked onto the portable platform 402, stored onto the portable platform 402, laid onto the portable platform 402, and the like. In general, it is to be appreciated and understood that any suitable cargo can be protected by the system 400 regardless of how such cargo is placed onto the portable platform 402.

The system 400 includes the corner protection member 100 in contact with the portable platform 402. In particular, the portable platform 402 is a standard reversible pallet. As depicted, the corner protection member 100 is in contact with a corner of the portable platform. Although not shown, the corner protection member 100 can contact cargo placed on the portable platform 402. With the use of straps (e.g., e-straps, banding, etc.), the straps can lace into the corner protection member 100 in order to alleviate force applied to cargo via the straps when tightened. In other words, the corner protection member 100 bears a force generated by the straps when the straps are tightened. Thus, rather than the cargo bearing the force and damaging the cargo, the corner protection member 100 bears such force.

As mentioned above, the subject innovation refers to the portable platform 402. It is to be appreciated that the portable platform 402 can be any suitable structure in which cargo is stacked or placed thereon for movement, shipment, delivery, and/or storage. For instance, the portable platform 402 can be, but is not limited to, a pallet, a wood pallet, a standard reversible pallet, a stevedore type double wing pallet, a premium panel deck stringer pallet, a heavy duty two way stringer pallet, a heavy duty stringer pallet notched for four-way entry, a grocery industry four-way pallet, a perimeter base block pallet, a single faced skid, a single wing pallet with option chamfer on bottom boards, and the like.

Figure 5:
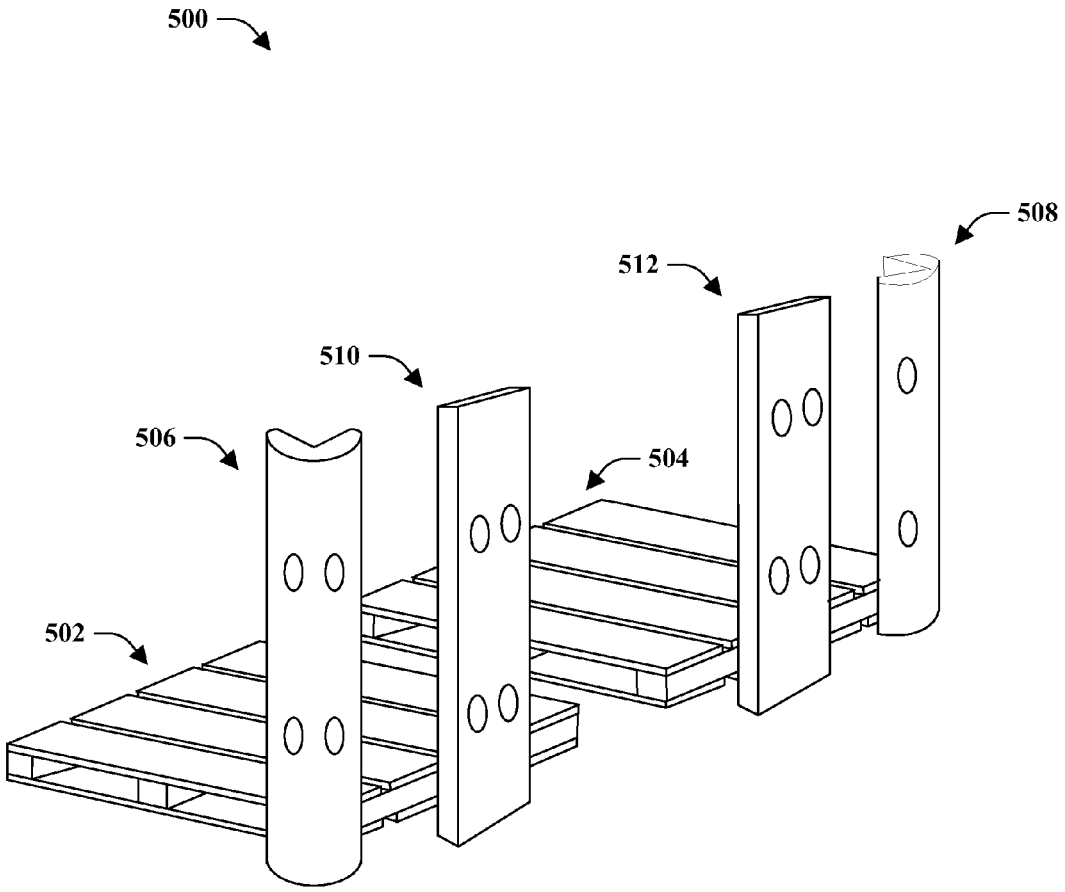
FIG. 5 illustrates a protection system that includes at least one corner protection member and at least one side protection member for two or more portable platforms.

FIG. 5 illustrates a protection system 500 that includes at least one corner protection member and at least one side protection member for two or more portable platforms. The protection system 500 can include a first portable platform 502 and a second portable platform 504. As discussed, the first portable platform 502 and the second portable platform 504 can include cargo (not shown) placed thereon, wherein the cargo can be any suitable cargo that is moved, stored, transported, delivered, etc. The protection system 500 can include any suitable number of corner protection members and/or side protection members. It is to be appreciated that the protection system 500 is solely for illustrative purposes and is not intended to be limiting on the subject innovation. For example, based on a layout of portable platforms, any suitable amount of corner protection members and/or side protection members can be employed.

The first portable platform 502 can include a first corner protection member 506 in contact with a corner of the first portable platform 502. Additionally, the second portable platform 504 can include a second corner protection member 508 in contact with a corner of the second portable platform 504. Further, a first side protection member 510 can be in contact with a side of the first portable platform 502. Similarly, a second side protection member 512 can be in contact with a side of the second portable platform 504. With such configuration, straps can be laced through the upper and/or lower set of openings on each of the first corner protection member 506, the first side protection member 510, the second side protection member 512, and the second corner protection member 508. Since the corner protection members and the side protection members have the straps laced thereto, a force associated with the tightening of such straps is alleviated by the members rather than cargo.

The corner protection members and/or the side protection members can be oriented in any suitable manner in order to protect cargo. In a particular example, a corner protection member can be placed on outside (e.g., away from a wall and/or e-track rail of a mode of transport) corners of portable platforms when the corners are on an outside perimeter. In another particular example, a side protection member can be placed on an outside (e.g., side that is away from a wall and/or e-track rail of a mode of transport) center location of each portable platform. It is to be appreciated that the configuration or placement of the corner protection member and/or the side protection member are not to be limiting on the subject innovation and any suitable confirmation (e.g., location of members, number of members, member contact location on portable platforms, etc.) can be employed with the subject innovation.

In yet another instance, the side protection member can be oriented on top of cargo on a portable platform such that at least one strap can be laced thereon to attach such cargo and portable platform to a floor/surface on a mode of transport.

The aforementioned systems, members, architectures, environments (e.g., corner protection member, side protection member, protection system, etc.), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein for the sake of brevity, but known by those of skill in the art.

Figure 6:
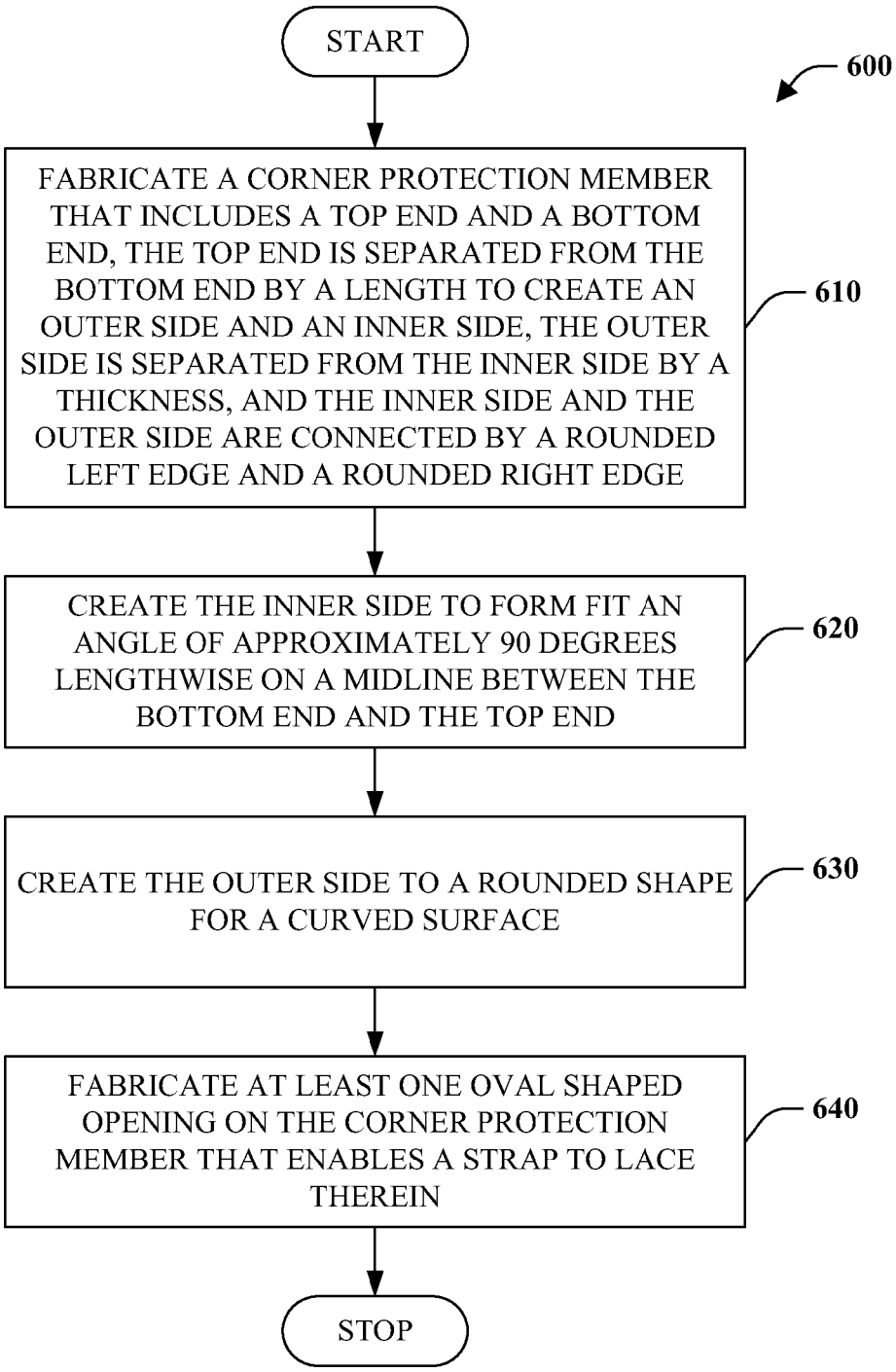
FIG. 6 is a flow chart diagram of a method of fabricating a corner protection member.
Figure 7:
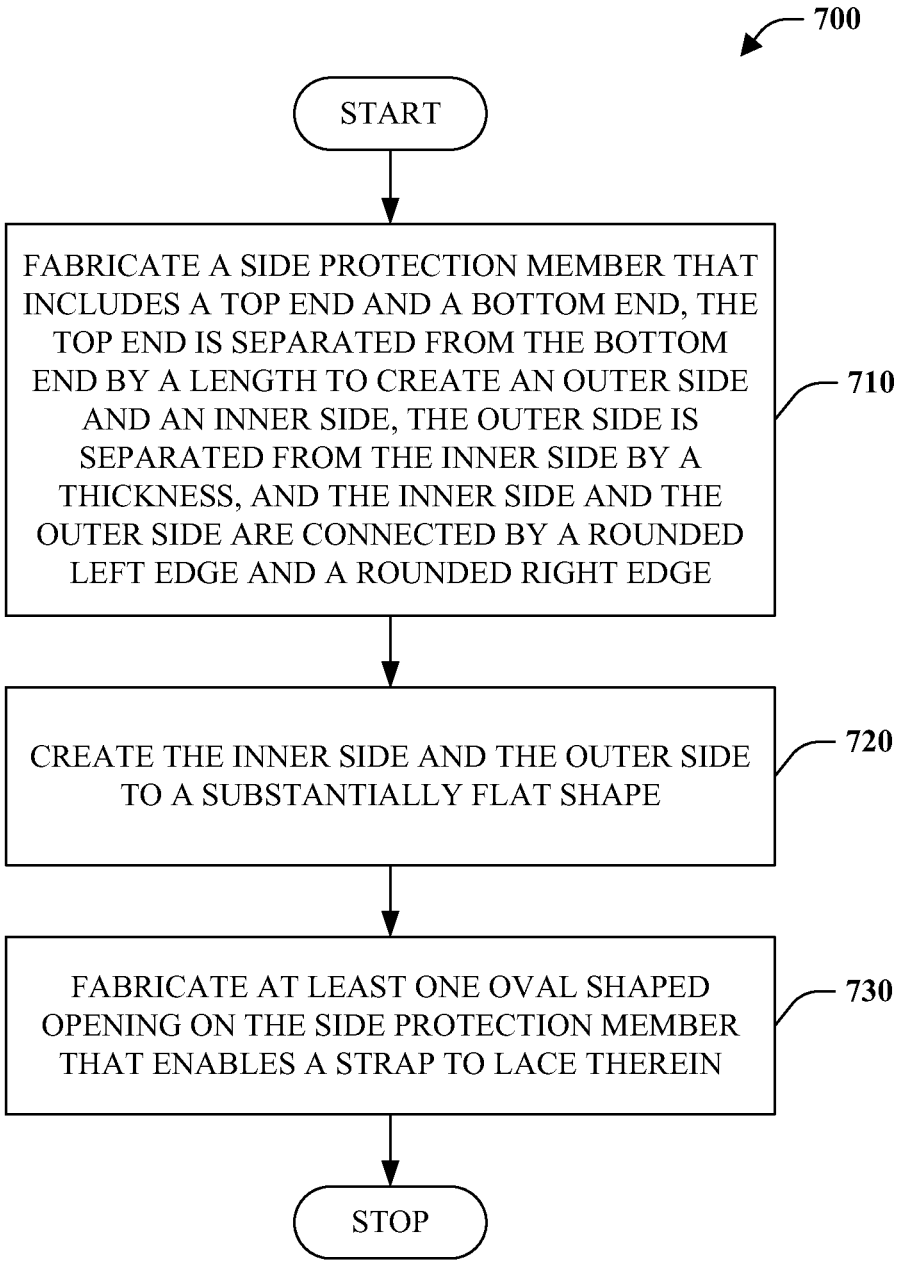
FIG. 7 is a flow chart diagram of a method of fabricating a side protection member.
Figure 8:
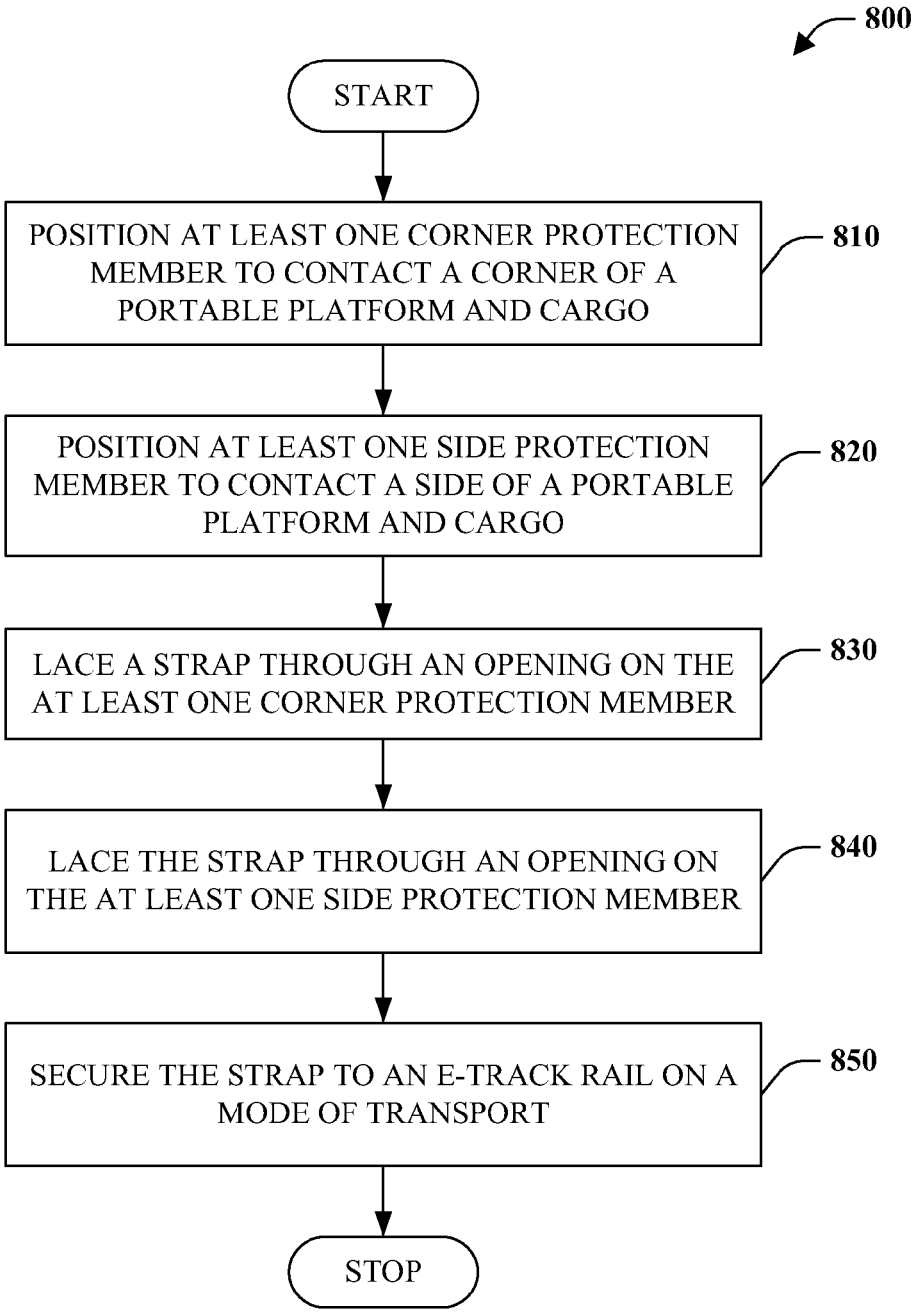
FIG. 8 is a flow chart diagram of a method of protecting cargo on a portable platform with at least one of a corner protection member or a side protection member.

In view of the exemplary devices and elements described supra, methodologies that may be implemented in accordance with the disclosed subject matter will be better appreciated with reference to the flow charts of FIGS. 6-8. While for purposes of simplicity of explanation, the methodologies are shown and described as a series of blocks, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described hereinafter.

FIG. 6 is a flow chart diagram of a method 600 of fabricating a corner protection member. At reference numeral 610, a corner protection member is fabricated to include a top end and a bottom end, the top end is separated from the bottom end by a length to create an outer side and an inner side, the outer side is separated from the inner side by a thickness, and the inner side and the outer side are connected by a rounded left edge and a rounded right edge. At reference numeral 620, the inner side is created to form fit an angle of approximately ninety (90) degrees lengthwise on a midline between the bottom end and the top end. It is to be appreciated that the corner fitting shape on the inner side can be rounded or curved rather than a sharp corner or 90 degree angle. At reference numeral 630, the outer side is created to a rounded shape for a curved surface. At reference numeral 640, at least one oval shaped opening is fabricated on the corner protection member that enables a strap to lace therein. For instance, the corner protection member can be constructed, fabricated, or made from a plastic, a high-density polyethylene, a carbon, a composite material, a metal, a wood, a synthetic material and/or any suitable combination thereof.

FIG. 7 is a flow chart diagram of a method 700 of fabricating a side protection member. At reference numeral 710, a side protection member is fabricated to include a top end and a bottom end, the top end is separated from the bottom end by a length to create an outer side and an inner side, the outer side is separated from the inner side by a thickness, and the inner side and the outer side are connected by a rounded left edge and a rounded right edge. At reference numeral 720, the inner side and the outer side are created to a substantially flat shape. At reference numeral 730, at least one oval shaped opening is fabricated on the side protection member that enables a strap to lace therein. For instance, the side protection member can be constructed, fabricated, or made from a plastic, a high-density polyethylene, a carbon, a composite material, a metal, a wood, a synthetic material and/or any suitable combination thereof.

FIG. 8 is a flow chart diagram of a method 800 of protecting cargo on a portable platform with at least one of a corner protection member or a side protection member. At reference numeral 810, at least one corner protection member is positioned to contact a corner of a portable platform and cargo. At reference numeral 820, at least one side protection member is positioned to contact a side of a portable platform and cargo. At reference numeral 830, a strap is laced through an opening on the at least one corner protection member. At reference numeral 840, the strap is laced through an opening on the at least one side protection member. At reference numeral 850, the strap is secured to an e-track rail on a mode of transport (e.g., vehicle, truck, trailer, plane, train, boat, freight vehicle, truck trailer, etc.).

What has been described above includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims.

Specific embodiments of an innovation are disclosed herein. One of ordinary skill in the art will readily recognize that the innovation may have other applications in other environments. In fact, many embodiments and implementations are possible. The following claims are in no way intended to limit the scope of the subject innovation to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components. Any components described herein may also interact with one or more other components not specifically described herein but generally known by those of skill in the art.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., members, components, assemblies, devices, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A system that facilitates preventing damage to cargo, comprising:

a corner protection member that includes a top end and a bottom end, the top end is separated from the bottom end by a length to create an outer side and an inner side, the outer side is separated from the inner side by a thickness;

the inner side is formed to fit a corner that is approximately a right angle, the corner fitting form is lengthwise on a midline between the bottom end and the top end;

the outer side is rounded for a curved surface;

the bottom end of the corner protection member includes a foot member that extends in a horizontal direction away from the inner side in which the foot member is substantially flat and is configured to slide under a portable platform;

an upper set of openings on an upper portion of the corner protection member, the upper set of openings includes a first opening centered between a left edge of the corner protection member and the midline and a second opening centered between a right edge of the corner protection member and the midline;

the first opening of the upper set of openings and the second opening of the upper set of openings lie on a same horizontal plane on the upper portion of the corner protection member;

a lower set of openings on a lower portion of the corner protection member, the lower set of openings includes a first opening centered between a left edge of the corner protection member and the midline and a second opening centered between a right edge of the corner protection member and the midline;

the first opening of the lower set of openings and the second opening of the lower set of openings lie on a same horizontal plane on the lower portion of the corner protection member;

the inner side of the corner protection member contacts a corner of the portable platform that supports a cargo; and at least one strap that secures the portable platform supporting the cargo by lacing through at least one of the lower set of openings on the lower portion of the corner protection member or the upper set of openings on the upper portion of the corner protection member.

2. The system of claim 1, the upper set of openings on the upper portion of the corner protection member is configured to be located at a height approximate to a securing point height.

3. The system of claim 1, the lower set of openings on the lower portion of the corner protection member is configured to be located at a height approximate to a securing point height.

4. The system of claim 1, the left edge and the right edge of the corner protection member are rounded edges.

5. The system of claim 1, the bottom end of the corner protection member includes at least one access opening to affix the corner protection member to the portable platform.

6. The system of claim 1, the length of the corner protection member is approximately seven (7) feet from the bottom end to the top end.

7. The system of claim 1 further comprises a padded material affixed on the inner side of the corner protection member.

8. The system of claim 1, the corner protection member is fabricated from at least one of a plastic, a high-density polyethylene, a carbon, a composite material, a metal, a wood, or a synthetic material.

9. The system of claim 1 further comprises:

a side protection member that includes a top end and a bottom end, the top end is separated from the bottom end by a length to create an outer side and an inner side, the outer side is separated from the inner side by a thickness;

the inner side and the outer side of the side protection member are substantially flat;

an upper set of openings on an upper portion of the side protection member, the upper set of openings includes a first opening centered between a left edge of the side protection member and a midline between the top end and the bottom end and a second opening centered between a right edge of the side protection member and the midline;

the first opening of the upper set of openings and the second opening of the upper set of openings lie on the same horizontal plane on the upper portion of the side protection member;

a lower set of openings on a lower portion of the side protection member, the lower set of openings includes a first opening centered between a left edge of the side protection member and the midline and a second opening centered between a right edge of the side protection member and the midline;

the first opening of the lower set of openings and the second opening of the lower set of openings lie on the same horizontal plane on the lower portion of the side protection member;

the inner side of the side protection member contacts a center side of the portable platform that supports the cargo; and at least one strap that secures the portable platform supporting the cargo by lacing through at least one of the lower set of openings on the lower portion of the side protection member or the upper set of openings on the upper portion of the side protection member.

10. The system of claim 9, the upper set of openings on the upper portion of the side protection member is configured to be located at a height approximate to a securing point height.

11. The system of claim 9, the lower set of openings on the lower portion of the side protection member is configured to be located at a height approximate to a securing point height.

12. The system of claim 9, the left edge and the right edge of the side protection member are rounded edges.

13. The system of claim 9, the bottom end of the side protection member includes a foot member that extends in a horizontal direction away from inner side of the side protection member in which the foot member is substantially flat and is configured to slide under the portable platform.

14. The system of claim 9, the bottom end of the side protection member includes at least one access opening to affix the side protection member to the portable platform.

15. The system of claim 9, the length of the side protection member is approximately seven (7) feet from the bottom end to the top end.

16. The system of claim 9 further comprises a padded material affixed on the inner side of the side protection member.

17. A corner protection apparatus, comprising:

a corner member that includes a top end and a bottom end, the top end is separated from the bottom end by a length to create an outer side and an inner side, the outer side is separated from the inner side by a thickness;

the inner side is formed to fit a corner that is approximately a right angle, the corner fitting form is lengthwise on a midline between the bottom end and the top end;

the outer side is rounded for a curved surface;

a left edge of the corner protection member connects a left side of the outer side to a left side of the inner side and a right edge of the corner protection member connects a right side of the outer side to a right side of the inner side, the left edge and the right edge of the corner protection member are rounded edges;

a first opening and a second opening on the corner member, the first opening and the second opening lie on the same horizontal plane of the corner member;

the inner side of the corner member contacts a corner of a portable platform that supports a cargo;

at least one strap that secures the portable platform supporting the cargo by lacing through the first opening and the second opening on the corner member a side member that includes a top end and a bottom end, the top end is separated from the bottom end by a length to create an outer side and an inner side, the outer side is separated from the inner side by a thickness;

the inner side and the outer side of the side protection member are substantially flat a first opening and a second opening on the side member, the first opening and the second opening lie on the same horizontal plane of the side member;

the inner side of the side protection member contacts a center side of the portable platform that supports the cargo; and at least one strap that secures the portable platform supporting the cargo by lacing through the first opening of the side member or the second opening of the side member.

18. A method of fabricating a cargo protection system, comprising:

fabricating a corner protection member to include a top end and a bottom end, the top end is separated from the bottom end by a length to create an outer side and an inner side, the outer side is separated from the inner side by a thickness, and the inner side and the outer side are connected by a rounded left edge and a rounded right edge;

creating the inner side to form fit an angle of approximately ninety (90) degrees lengthwise on a midline between the bottom end and the top end;

creating the outer side to a rounded shape for a curved surface;

fabricating at least one oval shaped opening on the corner protection member that enables a strap to lace therein;

fabricating a side protection member to include a top end and a bottom end, the top end is separated from the bottom end by a length to create an outer side and an inner side, the outer side is separated from the inner side by a thickness, and the inner side and the outer side are connected by a rounded left edge and a rounded right edge;

creating the inner side and the outer side to a substantially flat shape; and fabricating at least one oval shaped opening on the side protection member that enables a strap to lace therein; and fabricating a foot member on the bottom end of the corner protection member in which the foot member extends in a horizontal direction away from the inner side, wherein the foot member is substantially flat and is configured to slide under a portable platform.

19. The method of claim 18 further comprises:

positioning the corner protection member to contact a corner of a portable platform and cargo;

positioning the side protection member to contact a side of a portable platform and cargo;

lacing a strap through an opening on the corner protection member;

lacing the strap through an opening on the side protection member; and securing the strap on a mode of transport.

* * * * *